US010030504B2

(12) United States Patent
Zheng et al.

(10) Patent No.: US 10,030,504 B2
(45) Date of Patent: Jul. 24, 2018

(54) RECEIVING APPARATUS SUITABLE FOR AZIMUTHALLY ACOUSTIC LOGGING WHILE DRILLING

(71) Applicant: Institute of Geology and Geophysics, Chinese Academy of Sciences, Beijing (CN)

(72) Inventors: Jian Zheng, Beijing (CN); Qingyun Di, Beijing (CN); Wenxuan Chen, Beijing (CN); Wenxiu Zhang, Beijing (CN); Yuntao Sun, Beijing (CN); Yongyou Yang, Beijing (CN)

(73) Assignee: INSTITUTE OF GEOLOGY AND GEOPHYSICS, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 15/818,959

(22) Filed: Nov. 21, 2017

(65) Prior Publication Data

US 2018/0142546 A1 May 24, 2018

(30) Foreign Application Priority Data

Nov. 21, 2016 (CN) ..... 2016 1 1022798

(51) Int. Cl.
*E21B 47/085* (2012.01)
*E21B 47/08* (2012.01)
*E21B 47/01* (2012.01)

(52) U.S. Cl.
CPC ..... *E21B 47/082* (2013.01); *E21B 47/011* (2013.01); *E21B 47/08* (2013.01)

(58) Field of Classification Search
CPC ..... E21B 47/02208; E21B 47/024; E21B 47/026; E21B 47/08; E21B 47/082; E21B 47/011
See application file for complete search history.

(56) References Cited

U.S. PATENT DOCUMENTS 5,987,385 A * 11/1999 Varsamis ..... E21B 47/0002 702/6
7,096,313 B1 8/2006 Chang et al.
(Continued)

FOREIGN PATENT DOCUMENTS

CN 1740746 A 3/2006
CN 2849164 Y 12/2006
(Continued)

*Primary Examiner* — Brad Harcourt
(74) *Attorney, Agent, or Firm* — Novick, Kim & Lee, PLLC; Allen Xue

(57) ABSTRACT

An apparatus for receiving signals in azimuthally acoustic LWD includes a drill collar body, a circuit mounting frame, a receiving transducer, a sealing connector, a preposed processing circuit module, a first receiving signal processing circuit for processing a signal from the transducer, distance detecting sensors, at least one set of plugging assemblies, an electrical connector and a second receiving signal processing circuit for processing signals from the distance detecting sensors. The circuit mounting frame is located inside the drill collar body and connected with the drill collar body. The receiving apparatus integrates a borehole diameter measurement system and an azimuthally acoustic while drilling receiving system on one drill collar.

10 Claims, 4 Drawing Sheets

(56) References Cited

U.S. PATENT DOCUMENTS

| | | | | |
|---|---|---|---|---|
| 7,762,854 | B1 | 7/2010 | Peng | |
| 2001/0012703 | A1 | 8/2001 | Wurm et al. | |
| 2002/0075114 | A1 | 6/2002 | Hall et al. | |
| 2007/0247329 | A1 | 10/2007 | Petrovic et al. | |
| 2009/0023502 | A1 | 1/2009 | Koger | |
| 2009/0153355 | A1 | 6/2009 | Price et al. | |
| 2010/0118657 | A1* | 5/2010 | Trinh ..... | E21B 47/011 367/82 |
| 2012/0249338 | A1 | 10/2012 | Merino | |
| 2012/0299743 | A1 | 11/2012 | Price et al. | |
| 2014/0332235 | A1 | 11/2014 | Mueller et al. | |

FOREIGN PATENT DOCUMENTS

| | | | |
|---|---|---|---|
| CN | 101289935 | A | 10/2008 |
| CN | 201221354 | Y | 4/2009 |
| CN | 101493008 | A | 7/2009 |
| CN | 102418516 | A | 4/2012 |
| CN | 202187758 | U | 4/2012 |
| CN | 103061755 | A | 4/2013 |
| CN | 103577121 | A | 2/2014 |
| CN | 204283400 | U | 4/2015 |
| CN | 204283413 | U | 4/2015 |
| CN | 105353357 | A | 2/2016 |
| CN | 105760113 | A | 7/2016 |
| CN | 105804722 | A | 7/2016 |
| CN | 206299372 | U | 7/2017 |
| CN | 206299375 | U | 7/2017 |

* cited by examiner

RECEIVING APPARATUS SUITABLE FOR AZIMUTHALLY ACOUSTIC LOGGING WHILE DRILLING

TECHNICAL FIELD

The present invention pertains to the field of logging while drilling (LWD) measurement apparatuses, and particularly relates to a receiving apparatus suitable for use in azimuthally acoustic LWD.

BACKGROUND

With the increasing drilling scale of oil and gas fields and the development of science and technology, especially the rapid development of a LWD technology, it is urgent to make the present advanced science and technology play an important role in the development of the oil and gas fields. An azimuthally acoustic LWD technology is one of LWD technologies. Acoustic LWD realizes acoustic logging while drilling. Compared with wireline logging, the acoustic LWD obtains data which is less affected by invasion of a drilling fluid and can relatively effectively detect the lithological characters and physical properties and reservoir parameter of a borehole wall stratum. Compressional wave and shear wave velocities of the stratum are obtained by an acoustic LWD instrument. A pore pressure gradient and a permeability are established, a borehole stability is assessed, a lithological character change is explained, and a flow effect of fluid in a borehole is detected, thus important geological guidance information is provided for a drilling operation. However, since the acoustic LWD is affected by noise of a drilling tool, circulation of the drilling fluid and drill collar waves, in order to obtain high-quality data, technologies such as drill collar sound insulation, high-precision measurement, high-power acoustic transmission and high-sensitivity acoustic reception are essential. However, developing a transmitting apparatus and a receiving apparatus of the transducer has become a bottleneck problem due to problems involved in the installation, water tightness, pressure imbalance, as well as conflicts between low frequency and light weight and small size of the acoustic wave transducer in practical applications.

The azimuthally acoustic while drilling signal receiving transducer encapsulating structure mainly employs two structural solutions:

(1) an acoustic while drilling receiving apparatus based on a button-shaped receiving transducer may be suitable for monopole, dipole and multi-pole acoustic while drilling instruments. Since the button-shaped receiving transducer used is higher in receiving sensitivity, an acoustic signal transmitted by the acoustic transmitting apparatus can be well received in the LWD and due to a special structure of such a button-shaped receiving transducer, the transducer is easily damaged during operation; and (2) an acoustic while drilling receiving apparatus employing an annularly-potted receiving transducer is mainly used in a monopole acoustic while drilling instrument since multiple transducers are encapsulated in the same annular ribbon and are mutually connected in parallel.

However, the acoustic while drilling receiving apparatus based on a button-shaped receiving transducer is prone to failure since the button-shaped receiving transducer is easily damaged. Since the transducers realize high-pressure sealing with the drill collar while being installed on a frame of an internal electronic bin, such a structure increases requirements for machining and assembling the frame of the internal electronic bin and the external drill collar. Further, the receiving apparatus requires to be specially serially connected with a devices for borehole diameter measurement so that extremely high requirements for connection and reliability of the instrument are presented. However, the acoustic while drilling receiving apparatus based on an annularly-potted receiving transducer is mainly used in the monopole acoustic while drilling instrument.

In terms of the borehole diameter measurement, a hydraulic balance apparatus is required for encapsulation when a traditional ultrasonic distance detecting sensor is encapsulated; and however, it is larger in volume after hydraulic encapsulation is completed, and generally, may be directly mounted in the electronic bin or internal frame, accordingly, a space of a water hole inside the drill collar is occupied, resulting in complex structure and reduced reliability.

SUMMARY

In order to solve the above-mentioned technical challenges, the present invention provides a receiving apparatus suitable for azimuthally acoustic LWD, which integrates a borehole diameter measurement system and an azimuthally acoustic while drilling receiving system into one drill collar, and realizes isolation of an acoustic wave transducer and an ultrasonic distance detecting sensor from high-pressure mud by means of modular encapsulation of the acoustic wave transducer and the ultrasonic distance detecting sensor and a sealing structure design.

In an embodiment of the present disclosure, a receiving apparatus suitable for azimuthally acoustic LWD includes a drill collar body 1, a circuit mounting frame 8, a borehole diameter measurement system, and an azimuthally acoustic while drilling receiving system, wherein the circuit mounting frame 8 is located inside the drill collar body 1.

The while drilling azimuthally acoustic receiving system includes a receiving transducer 6, a sealing connector 7, a preposed signal processing circuit module 9 that is disposed close to the signal transducer and a first received signal processing circuit 10-1 for processing a signal from the transducer. The receiving transducer 6 is electrically connected with the preposed processing circuit module 9 through the sealing connector 7. The preposed processing circuit module 9 and the first received signal processing circuit 10-1 are electrically connected.

The borehole diameter measurement system includes distance detecting sensors 15, at least one set of plugging assemblies, an electrical connector 19, and a second received signal processing circuit 10-2 for processing a signal from the distance detecting sensors. The distance detecting sensors 15 are connected with the electrical connector 19 through the at least one set of plugging assemblies, and the electrical connector 19 and the second received signal processing circuit 10-2 are electrically connected.

One end of the circuit mounting frame 8 is connected with the drill collar body 1 through a MWD adapter 3 and the other end through a tail locking structure. The receiving transducer 6, the sealing connector 7, the preposed processing circuit module 9, the distance detecting sensors 15, the at least one set of plugging assemblies and the electrical connector 19 are mounted on the drill collar body 1 in high-pressure sealing manner. The first received signal processing circuit 10-1 and the second received signal processing circuit 10-2 are separately mounted on the circuit mounting frame. The preposed processing circuit module 9 includes a signal amplifying circuit and an analog-to-digital conversion circuit.

Further, the receiving transducer 6 includes an azimuth sensor and an encapsulating structure of the azimuth sensor. The encapsulating structure is formed by potting of an epoxy resin to realize high-pressure sealing of the azimuth sensor. The receiving transducer 6 is mounted on the drill collar body 1 by a fixing apparatus, a signal receiving cable of the receiving transducer is led out through an encapsulating apparatus and connected with the sealing connector 7.

Further, the distance detecting sensors 15 and the preposed processing circuit module 9 are affixed to the drill collar body 1 via a second fixing apparatus and a third fixing apparatus, respectively. Sealing rings are disposed outside the second fixing apparatus and the third fixing apparatus to realize high-pressure sealing. An orifice is provided in the second fixing apparatus, and signal cables of the distance detecting sensors 15 are led out of the second fixing apparatus via the orifice in the second fixing apparatus and connected with the plugging assemblies.

Further, the first received signal processing circuit 10-1 is connected with an electrical connector, and the preposed processing circuit module 9 is connected with the electrical connector through a signal transmission cable to realize electric connection with the first received signal processing circuit 10-1.

Further, the tail locking structure includes two tensioning half rings 11 with triangular cross sections, a locking ring 12 and a number of mounting screws. The two tensioning half rings 11 respectively matches with the circuit mounting frame 8 by means of a triangular bevel. The tensioning half rings are made of a beryllium bronze material. The locking ring 12 is connected with the circuit mounting frame 8 by means of the mounting screws. During installation, the screws exerts a force on the locking ring 12 so as to push the tensioning half rings 11 against the triangular bevel in the circuit mounting frame 8. At the same time, the force exerted on the two tensioning half rings creates a force that pushes the two tensioning half rings outwardly against the inner surface of the drill collar body 1 so as to secure the circuit mounting frame 8 relative to the drill collar body 1.

Further, the encapsulating structure of the receiving transducer 6 is a structure have one cambered external surface that is in contact with the receiving transducer 6. The first fixing apparatus has a cambered surface as well.

Further, one end of the MWD adapter 3 and the circuit mounting frame 8 are locked into a unitary structure by means of a positioning apparatus. The other end of the MWD adapter 3 is subjected to high-pressure sealing from the drilling fluid channel of the drill collar body 1. The joint between the MWD adapter 3 and the circuit mounting frame 8 also has a high pressure seal.

Further, the electrical connector 19 is a dual-core electrical connector, while each set of plugging assemblies includes a dual-core socket. A dual-core coaxial sealing pin and a dual-core sealing socket are mutually matched. The number of the sets of the plugging assemblies used for the receiving apparatus is determined according to a situation between the distance detecting sensors 15 and the second received signal processing circuit 10-2, which shall be minimum as long as the joint is sealed.

Further, the receiving apparatus includes three independent borehole diameter measurement systems. The three distance detecting sensors 15 are evenly distributed along a circumferential direction of the drill collar body 1. All three distance detecting sensors transmit signals using independent signal transmission channels and sealed channels so that the downhole operation reliability of the ultrasonic distance detecting sensors is improved.

Further, the receiving apparatus includes 12 receiving transducers 6. The receiving transducers are divided into two receiving arrays, each having six receiving transducers. The two receiving arrays are distributed on the drill collar body 1 at an angle of 180 degrees between them. Each receiving transducer employs its own separate transducer encapsulation and its own preposed signal processing circuit.

The present invention has advantageous effects that: such a receiving apparatus suitable for azimuthally acoustic LWD may be applied to acoustic wave receiving systems of dipole and multi-pole azimuthally acoustic while drilling instruments. The receiving apparatus integrates a borehole diameter measurement system and an azimuthally acoustic while drilling receiving system into one drill collar, and realizes isolation of the acoustic wave transducer and the ultrasonic distance detecting sensors from high-pressure mud by means of modular encapsulation of the acoustic wave transducer and the ultrasonic distance detecting sensors and a sealing structure design. The transmission of the signals in the drill collar and the mud is made possible by adopting a high-pressure sealing connector and a sealing connection structure connected with the transducer. Furthermore, the receiving transducer, the ultrasonic distance detecting transducers and the preposed signal processing circuits, which are modularly designed, provide a favorable solution for reception, extraction and transmission of weak acoustic signals.

DETAILED DESCRIPTION

Objectives, technical solutions and advantages of the present invention will become more apparent from the following detailed description of the present invention when taken in conjunction with accompanying drawings. It should be understood that specific embodiments described herein are merely illustrative of the present invention and are not intended to limit the present invention.

Rather, the present invention encompasses any alternatives, modifications, equivalents, and solutions made within the spirit and scope of the present invention as defined by the claims. Further, in order to give the public a better understanding of the present invention, some specific details are described below in detail in the following detailed description of the present invention. It will be appreciated by those skilled in the art that the present invention may be understood without reference to the details.

Example 1

Figure 1:
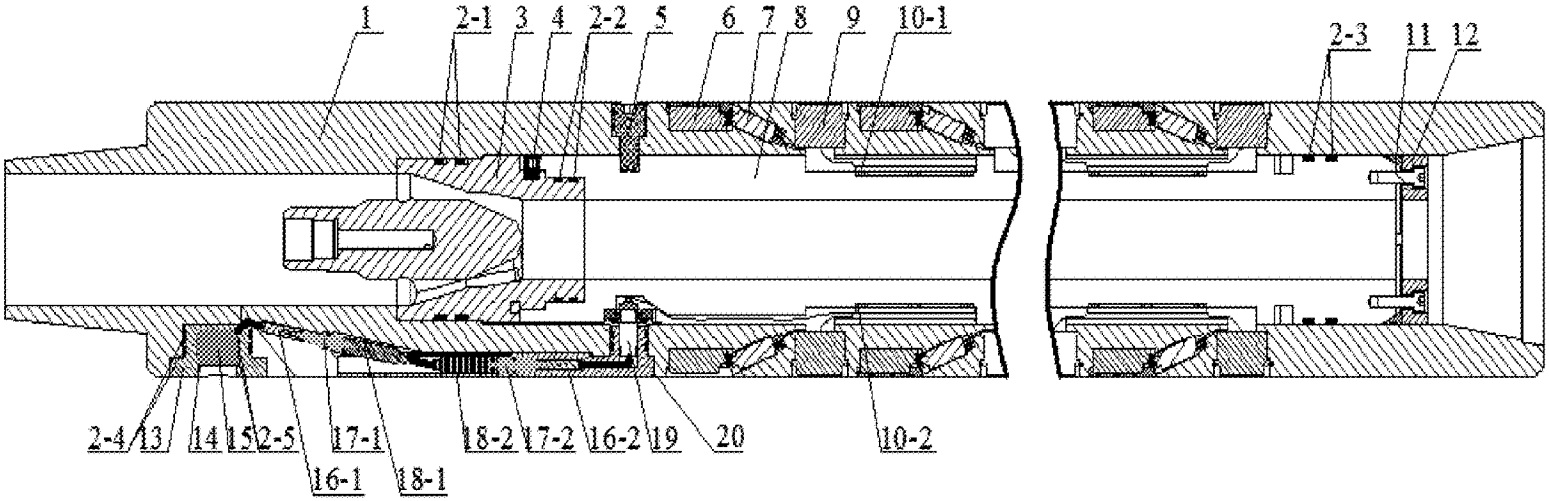
FIG. 1 is a schematic diagram showing a receiving apparatus suitable for azimuthally acoustic LWD.

A receiving apparatus suitable for azimuthally acoustic LWD contains a borehole diameter measurement system and an azimuthally acoustic while drilling receiving system. As shown in FIG. 1, the receiving apparatus includes a drill collar body 1, a circuit mounting frame 8, a borehole diameter measurement system, and an azimuthally acoustic while drilling receiving system, wherein the circuit mounting frame 8 is located inside the drill collar body 1.

The azimuthally acoustic while drilling receiving system includes a receiving transducer 6, a sealing connector 7, a preposed processing circuit module 9 and a first received signal processing circuit 10-1 for processing a signal from the transducer. The receiving transducer 6 is electrically connected with the preposed processing circuit module 9 through the sealing connector 7. The preposed processing circuit module 9 and the first received signal processing circuit 10-1 are electrically connected.

The borehole diameter measurement system includes distance detecting sensors 15, at least one set of plugging assemblies, an electrical connector 19, and a second received signal processing circuit 10-2 for processing signals from the distance detecting sensors. The distance detecting sensors 15 are connected with the electrical connector 19 through two sets of plugging assemblies. The electrical connector 19 and the second received signal processing circuit 10-2 are electrically connected.

In one embodiment, the receiving apparatus suitable for azimuthally acoustic LWD includes the following components: a drill collar body 1, a first sealing ring 2-1, a MWD adapter 3, positioning pins 4, a second sealing ring 2-2, sealing positioning pins 5, a receiving transducer 6, a sealing connector 7, a circuit mounting frame 8, a preposed processing circuit module 9, a first received signal processing circuit 10-1, a third sealing ring 2-3, tensioning half rings 11, a locking ring 12, a fourth sealing ring 2-4, distance detecting sensor sealing covers 13, a retaining ring 14, distance detecting sensors 15, a fifth sealing ring 2-5, a first dual-core socket 16-1, a first dual-core coaxial sealing pin 17-1, a first dual-core sealing socket 18-1, a second dual-core socket 16-2, a second dual-core coaxial sealing pin 17-2, a second dual-core sealing socket 18-2, a dual-core electrical connector 19, a sealing connection cover 20, and a second received signal processing circuit 10-2.

One end of the MWD adapter 3 and the circuit mounting frame 8 are locked into a unitary structure by means of a positioning device. The other end of the MWD adapter 3 is subjected to high-pressure sealing so as to be sealed from the drilling fluid channel in the drill collar body 1. The joint between the MWD adapter 3 and the circuit mounting frame 8 also has a high pressure seal.

In one embodiment, the circuit mounting frame 8 and the MWD adapter 3 are locked into a unitary structure by means of three positioning pins 4 evenly distributed circumferentially. The second sealing ring 2-2 is mounted at a position, which is connected with the circuit mounting frame 8, of the MWD adapter 3 to realize high-pressure sealing from the drilling fluid channel in the drill collar body. The other end of the MWD adapter 3 is connected with the drill collar body 1 through the first sealing ring 2-1 to achieve high-pressure sealing from in the drill collar body 1. The circuit mounting frame 8 is circumferentially positioned by means of two sealing positioning pins 5 which are distributed radially at an angle of 90 degrees, while the sealing positioning pins 5 and the drill collar body realize high-pressure sealing by the sealing ring to block mud from entering the circuit mounting frame 8. The other end of the circuit mounting frame 8 realizes high-pressure sealing by the third sealing ring 2-3. In this way, the circuit mounting frame 8 realizes high-pressure sealing from the drilling fluid channel inside by means of the first sealing ring 2-1, the second sealing ring 2-2, and the third sealing ring 2-3.

Figure 2:
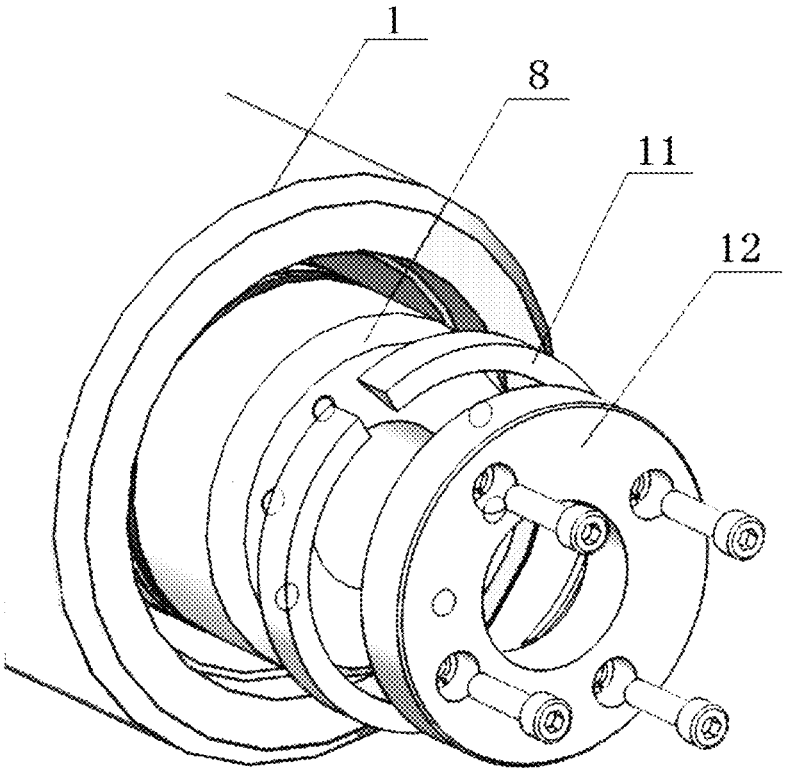
FIG. 2 is a schematic diagram showing a locking structure of an electronic frame.

In addition, the circuit mounting frame 8 is connected with the drill collar body 1 in a fastening manner by the tail locking device as shown in FIG. 2. The tail locking device of two tensioning half rings 11 with triangular cross sections, a locking ring 12 and a number of mounting screws, wherein the two tensioning half rings 11 are respectively matched with the circuit mounting frame 8 by means of a triangular bevel. The tensioning half rings 2 are made of a beryllium bronze material, and the locking ring 12 is connected with the circuit mounting frame 8 by the screw. During installation, the screws exerts a force on the locking ring 12 so as to push the tensioning half rings 11 against the triangular bevel in the circuit mounting frame 8. At the same time, the force exerted on the two tensioning half rings creates a force that push the two tensioning half rings outwardly against the inner surface of the drill collar body 1 so as to secure the circuit mounting frame 8 relative to the drill collar body 1.

Figure 4:
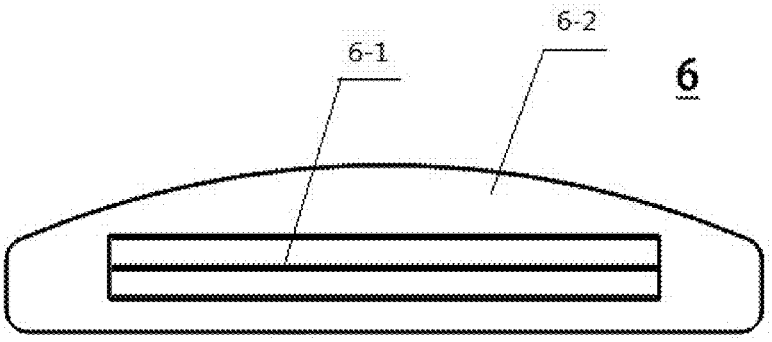
FIG. 4 is a schematic diagram showing a structure of a receiving transducer; and wherein 1. drill collar body; 2-1. first sealing ring; 3. MWD adapter; 4. positioning pin; 2-2. second sealing ring; 5. sealing positioning pin; 6. receiving transducer; 7. sealing connector; 8. circuit mounting frame; 9. preposed processing circuit module; 10-1. first received signal processing circuit; 2-3. third sealing ring; 11. tensioning half ring; 12. locking ring; 2-4. fourth sealing ring; 13. distance detecting sensor sealing cover; 14. retaining ring; 15. distance detecting sensor; 2-5. fifth sealing ring; 16-1. first dual-core socket; 17-1. first dual-core coaxial sealing pin; 18-1. first dual-core sealing socket; 16-2. second dual-core socket; 17-2. second dual-core coaxial sealing pin; 18-2. second dual-core sealing socket; 19. dual-core electrical connector; 20. sealing connection cover; 10-2. second received signal processing circuit; 6-1. sensor; and 6-2. encapsulating structure of sensor.

The azimuthally acoustic while drilling receiving system of the receiving apparatus suitable for azimuthally acoustic LWD has twelve receiving transducers. Six receiving transducers form one receiving array. The two receiving arrays are distributed at an angle of 180 degrees to each other. Each receiving transducer employs a separate transducer encapsulation and is connected to a preposed signal processing circuit. The transducer is potted by adopting an epoxy resin potting process and may be used in a mud environment. Its structure is as shown in FIG. 4.

The receiving transducer 6 is mounted on the drill collar body 1 by means of a fixing apparatus. The receiving apparatus is a gland, a signal receiving cable of which is led into the preposed processing circuit module 9 through the sealing connector 7. The sealing connector 7 is affixed to the drill collar body 1 by the retaining ring. The sealing connector 7 prevents the high-pressure mud from entering the preposed processing circuit module 9 while achieving signal transmission. The preposed processing circuit module 9 is affixed to the drill collar body 1 by the third fixing apparatus. The third fixing apparatus is a retaining ring and is connected with the first received signal processing circuit 10-1 on the circuit mounting frame 8 through the signal cable. The preposed processing circuit module 9 also achieves high-pressure sealing with the external mud through an O-shaped sealing ring. In addition, the preposed processing circuit module 9 has a cylindrical cross section. It is secured in place by the retaining ring and does not fall off due to strong vibrations downhole, thereby improving the structural reliability. Such an encapsulating manner is particularly suitable for dipole and multi-pole acoustic while drilling instruments.

The borehole diameter measurement system of the receiving apparatus suitable for azimuthally acoustic LWD measures a borehole diameter by adopting three ultrasonic distance detecting sensors that are evenly distributed at an angle of 120 degrees. Meanwhile, the three ultrasonic distance detecting sensors perform signal transmission by adopting mutually-independent signal transmission channels and sealing channels so that the downhole operation reliability of the ultrasonic distance detecting sensors is improved. The ultrasonic distance detecting sensors are of a modular design, the distance detecting sensors 15 are affixed to the drill collar body by means of the second fixing apparatus. The second fixing apparatus includes a distance detecting sensor sealing cover 13 and a retaining ring 14. The distance detecting sensors 15 are mounted on the distance detecting sensor sealing cover 13 and secured in place by means of the retaining ring 14.

The distance detecting sensors 15 and the distance detecting sensor sealing cover 13 realize high-pressure sealing by means of the fifth sealing ring 2-5. The distance detecting sensor sealing cover 13 is mounted on the drill collar body 1 by means of the screw and sealed by means of the fourth sealing ring 2-4. The distance detecting sensors 15 are electrically connected by means of two sets of plugging assemblies and the electrical connector 19. The two sets of plugging assemblies include a first dual-core socket 16-1, a first dual-core coaxial sealing pin 17-1, a first dual-core sealing socket 18-1, a second dual-core socket 16-2, a second dual-core coaxial sealing pin 17-2 and a second dual-core sealing socket 18-2. Signal transmission cables of the distance detecting sensors 15 are led out via a small hole provided in the distance detecting sensor sealing cover 13 and connected with the first dual-core socket 16-1.

The first dual-core coaxial sealing pin 17-1 is mounted on the drill collar body 1 by means of a thread and realizes sealing the external mud by means of the O-shaped sealing ring. One side of the first dual-core coaxial sealing pin 17-1 is engaged with the first dual-core socket 16-1 and one side of the first dual-core coaxial sealing pin 17-1 is engaged with the first dual-core sealing socket 18-1 for realizing signal transmission. The first dual-core sealing socket 18-1 is immersed in the drilling mud during operation. The first dual-core sealing socket 18-1 is connected with the second dual-core sealing socket 18-2 by means of a signal transmission cable, the second dual-core coaxial sealing pin 17-2 is mounted in the sealing connection cover 20, its internal portion realizes sealing with the mud by means of its O-shaped sealing ring and its external portion realizes sealing with the mud by means of the O-shaped sealing ring on the sealing connection cover 20. One side of the second dual-core coaxial sealing pin 17-2 is connected with the second dual-core sealing socket 18-2 while one side of the second dual-core coaxial sealing pin is connected with the second dual-core socket 16-2. The second dual-core sealing socket 18-2 is soaked in the drilling mud during operation. The second dual-core socket 16-2 is connected with the dual-core electrical connector 19 by means of a signal transmission cable inside the sealing connection cover 20, and signals from the distance detecting sensors 15 are transmitted to the second received signal processing circuit 10-2 by means of the dual-core electrical connector 19.

Figure 3:
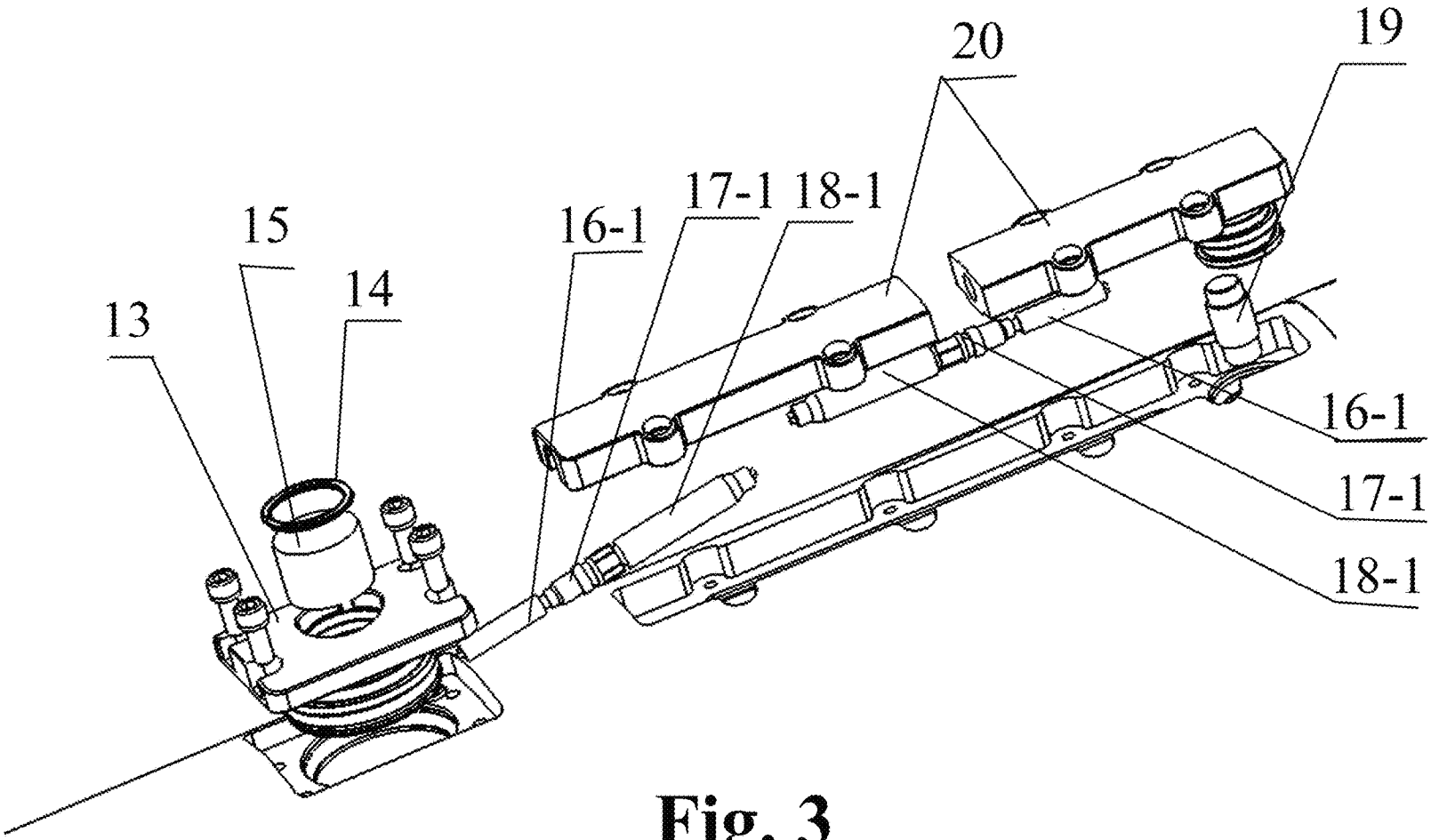
FIG. 3 is a schematic diagram showing assembly of a receiving apparatus suitable for azimuthally acoustic LWD.

As shown in FIG. 3, a specific assembling process of the receiving apparatus suitable for azimuthally acoustic LWD includes the following steps.

First, (1) mounting a first sealing ring 2-1 and a second sealing ring 2-2 on a MWD adapter 3 and applying lubricating grease on the sealing rings; (2) combining a circuit mounting frame 8 with the MWD adapter 3, locking it by means of three locking pins 4 evenly distributed along the circumferential direction, and fixing positioning pins by a retaining ring; (3) after the assembly is completed, inserting the circuit mounting frame 8 into a drill collar body 1 together with the MWD adapter 3, and rotating the circuit mounting frame 8 in an insertion process to align a positioning hole in the circuit mounting frame 8 to a positioning pin hole in the drill collar body 1; (4) mounting a sealing positioning pins 5 to position the drill collar body 1 and the circuit mounting frame 8; and (5) mounting a tail locking structure, that is, locking the circuit mounting frame 8 by means of tensioning half rings 11 and a locking ring 12.

Second, (1) fixing a sealing connector 7 on the drill collar body 1 by using the retaining ring and connecting a signal transmission cable at the tail end of the sealing connector 7 with a processing circuit in the preposed processing circuit module 9 via a small hole; (2) mounting a receiving transducer 6 on the drill collar body 1 by a gland and connecting its signal transmission cable with the sealing connector 7; (3) connecting a multi-core connector of the preposed processing circuit module 9 with a connector on the circuit mounting frame 8; (4) fixing the preposed processing circuit module 9 on the drill collar body by means of the retaining ring; and sequentially mounting the left receiving transducers according to the same order.

Third, (1) engaging a first dual-core socket 16-1 with a first dual-core coaxial sealing pin 17-1, and leading a signal transmission cable at the tail portion of the first dual-core socket 16-1 out and then connecting it with a signal transmission cable of a distance detecting sensor 15 by soldering; (2) mounting the first dual-core coaxial sealing pin 17-1 on the drill collar body, and mounting one side of the first dual-core socket 16-1 inside the drill collar; (3) mounting the fourth sealing ring 2-4 and the fifth sealing ring 2-5 on a distance detecting sensor sealing cover 13, uniformly applying lubricating grease on the sealing rings, then mounting the distance detecting sensor 15 on the distance detecting sensor sealing cover 13, leading its signal transmission cable out via a small hole in the distance detecting sensor sealing cover 13 and connecting it with the signal transmission cable at the tail portion of the first dual-core socket 16-1; (4) mounting the distance detecting sensor sealing cover 13 on the drill collar body 1 by means of a screw; (5) engaging a second dual-core socket 16-2 with a second dual-core coaxial sealing pin 17-2, mounting the second dual-core coaxial sealing pin 17-2 in a seal connection cover 20, connecting a signal transmission cable at the tail portion of the second dual-core socket 16-2 with a signal transmission cable of the dual-core electrical connector 19 by means of soldering inside the sealing connection cover 20, and after the connection is completed, abutting the dual-core electrical connector 19 with a socket on the circuit mounting frame 8, and mounting the sealing connection cover 20 on the drill collar body 1 by means of a screw; (6) connecting a first dual-core sealing socket 18-1 and a second dual-core sealing socket 18-2 with the first dual-core coaxial sealing pin 17-1 and the second dual-core coaxial sealing pin 17-2, respectively and mounting the sealing connection cover 20; and mounting the remaining two distance detecting sensors according to the same order.

The invention claimed is:

1. A receiving apparatus for azimuthally acoustic LWD, comprising: a drill collar body, a circuit mounting frame, a borehole diameter measurement system, and an azimuthally acoustic while drilling receiving system, wherein the circuit mounting frame is located inside the drill collar body, wherein the azimuthally acoustic while drilling receiving system comprises a receiving transducer, a sealing connector, a preposed processing circuit module, and a first received signal processing circuit for processing a signal from the transducer, wherein the receiving transducer is electrically connected with the preposed processing circuit module through the sealing connector, and the preposed processing circuit module and the first received signal processing circuit are electrically connected, wherein the borehole diameter measurement system comprises distance detecting sensors, at least one set of plugging assemblies, an electrical connector, and a second received signal processing circuit for processing signals from the distance detecting sensors, wherein the distance detecting sensors are connected with the electrical connector through the at least one set of plugging assemblies, and the electrical connector and the second received signal processing circuit are electrically connected, wherein two ends of the circuit mounting frame are connected with the drill collar body by a MWD adapter and a tail locking structure, respectively, wherein the receiving transducer, the sealing connector, the preposed processing circuit module, the distance detecting sensors, the at least one set of plugging assemblies and the electrical connector are mounted on the drill collar body in a high-pressure sealing manner, wherein the first received signal processing circuit and the second received signal processing circuit are respectively mounted on the circuit mounting frame, and the preposed processing circuit module comprises a signal amplifying module and an analog-to-digital conversion module.

2. The receiving apparatus according to claim 1, wherein the receiving transducer comprises an azimuth sensor and an encapsulating structure of the azimuth sensor, wherein the encapsulating structure is formed by potting of an epoxy resin to realize high-pressure sealing of the azimuth sensor, the receiving transducer is mounted on the drill collar body by a fixing apparatus, and a signal receiving line of the receiving transducer is led out through an encapsulating apparatus and connected with the sealing connector.

3. The receiving apparatus according to claim 2, wherein the encapsulating structure of the receiving transducer is a structure of which one external side is a cambered surface, and a surface of the first fixing apparatus in contact with the receiving transducer is a cambered surface.

4. The receiving apparatus according to claim 1, wherein the distance detecting sensors and the preposed processing circuit module are affixed to the drill collar body via a second fixing apparatus and a third fixing apparatus, respectively, and sealing rings are disposed outside the second fixing apparatus and the third fixing apparatus to realize high-pressure sealing; a hole is provided in the second fixing apparatus, and signal transmission cables of the distance detecting sensors are led out of the second fixing apparatus via the hole in the second fixing apparatus and connected with the plugging assemblies.

5. The receiving apparatus according to claim 1, wherein the first received signal processing circuit is connected with an electrical connector, and the preposed processing circuit module is connected with the electrical connector through a signal transmission cable to realize electric connection with the first received signal processing circuit.

6. The receiving apparatus according to claim 1, wherein the tail locking structure comprises two tensioning half rings with triangular cross sections, a locking ring, and a mounting screw, wherein the two tensioning half rings are respectively matched with the circuit mounting frame by means of a triangular bevel, the tensioning half rings are made of a beryllium bronze material, and the locking ring is connected with the circuit mounting frame by means of the screw; during installation, a screwing force of the screw acts on the locking ring to move to the left, so as to push the tensioning half rings to move to the left along the circuit mounting frame, and the diameter of a cylindrical surface formed by the two tensioning half rings is increased while the tensioning half rings are moved to the left, so that locking with the drill collar body is achieved.

7. The receiving apparatus according to claim 1, wherein one end of the MWD adapter and the circuit mounting frame are locked into a unitary structure by means of a positioning apparatus; the other end of the MWD adapter has a high-pressure sealing with a water hole of the drill collar body; and a connection between the MWD adapter and the circuit mounting frame has a high-pressure sealing.

8. The receiving apparatus according to claim 1, wherein the electrical connector is a dual-core electrical connector, each set of plugging assemblies comprises a dual-core socket, a dual-core coaxial sealing pin, and a double-core sealing socket which are mutually matched.

9. The receiving apparatus according to claim 1, wherein the receiving apparatus comprises three mutually-independent borehole diameter measurement systems, wherein the three distance detecting sensors are evenly distributed in a circumferential direction of the drill collar body and the three distance detecting sensors transmit signals by adopting mutually-independently signal transmission channels and sealing channels.

10. The receiving apparatus according to claim 1, wherein the receiving apparatus comprises twelve receiving transducers, wherein the twelve receiving transducers are divided into two receiving arrays, each receiving array consists of 6 receiving transducers, the two receiving arrays are distributed on the drill collar body at an angle of 180 degrees, each receiving transducer employs separate transducer encapsulation and preposed signal processing circuits.

* * * * *